US007393266B2

(12) United States Patent
Stallegger

(10) Patent No.: US 7,393,266 B2
(45) Date of Patent: Jul. 1, 2008

(54) KNIFE SHARPENING APPARATUS

(76) Inventor: Harald Stallegger, Rupertgasse 5, A-5020 Salzburg (AT)

( * ) Notice: Subject to any disclaimer, the term of this patent is extended or adjusted under 35 U.S.C. 154(b) by 0 days.

(21) Appl. No.: 10/589,093

(22) PCT Filed: Jan. 13, 2005

(86) PCT No.: PCT/EP2005/000252

§ 371 (c)(1),
(2), (4) Date: Apr. 19, 2007

(87) PCT Pub. No.: WO2005/080049

PCT Pub. Date: Sep. 1, 2005

(65) Prior Publication Data

US 2007/0224922 A1 Sep. 27, 2007

(30) Foreign Application Priority Data

Feb. 11, 2004 (DE) ..... 10 2004 006 714

(51) Int. Cl.
*B24B 21/00* (2006.01)
*B24B 9/02* (2006.01)

(52) U.S. Cl. ..... 451/312; 451/485; 451/555

(58) Field of Classification Search ..... 451/312, 451/45, 483–486, 555
See application file for complete search history.

(56) References Cited

U.S. PATENT DOCUMENTS

| | | | | |
|---|---|---|---|---|
| 2,124,646 | A * | 7/1938 | Barsch | 451/486 |
| 2,435,672 | A | 2/1948 | Clark | |
| 4,450,653 | A * | 5/1984 | Fletcher | 451/552 |
| 4,718,200 | A | 1/1988 | Miquelot | |
| 4,934,110 | A * | 6/1990 | Juranitch | 451/486 |
| 5,040,435 | A * | 8/1991 | Millman | 76/86 |
| 5,440,953 | A * | 8/1995 | Gangelhoff et al. | 76/86 |
| 5,655,959 | A * | 8/1997 | Juranitch | 451/486 |
| 6,866,569 | B2 * | 3/2005 | Cozzini | 451/349 |
| 2003/0077991 | A1 | 4/2003 | Lohnert | |
| 2004/0014415 | A1 | 1/2004 | Stallegger et al. | |

FOREIGN PATENT DOCUMENTS

| | | |
|---|---|---|
| FR | 2 118 320 A | 7/1972 |
| GB | 517 242 A | 1/1940 |
| WO | WO 02/34470 | 5/2002 |

* cited by examiner

*Primary Examiner*—Dung Van Nguyen
(74) *Attorney, Agent, or Firm*—Flynn, Thiel, Boutell & Tanis, P.C.

(57) ABSTRACT

The invention relates to a pocket-sized knife sharpening device comprising two sharpening bars which are arranged in a housing and which are rotationally mounted. The sharpening bars are guided with the other ends thereof into arc-shaped recesses in the front wall and the rear wall of the housing. They are loaded onto each other by means of springs and cross each other in a knife opening which is formed by slits extending in a parallel manner in relation to each other in the front wall of the rear wall.

20 Claims, 2 Drawing Sheets

KNIFE SHARPENING APPARATUS

FIELD OF THE INVENTION

This invention relates to a knife sharpening apparatus.

BACKGROUND OF THE INVENTION

Provided here on a base is a vertical plate having the sharpening rods mounted thereon with pins which are inserted through a recess in the plate and fastened with a counterscrew on the other side of the plate. Similarly, pins secured with corresponding counterscrews reach at the side of the plate. Similarly, pins secured with corresponding counterscrews reach at the other end of the sharpening rods through the curved guides formed as slots in the plate.

The known apparatus has proved extremely useful, but it is too large and too heavy to be transported in a pocket.

It is therefore the problem of the invention to provide such a knife sharpening apparatus in pocket size.

SUMMARY OF THE INVENTION

This is obtained according to the invention by the sharpening rods being disposed and mounted in a housing whose front wall and back wall are provided, for forming a knife insertion opening, with mutually parallel slots which are open at one end and closed at the other end.

The housing is preferably flat and substantially cuboid, i.e. the front and back walls extend plane-parallel. It is preferably approximately palm-sized, so that the inventive apparatus can be carried comfortably in a pocket. That is, the housing preferably has a length and width of 5 to 10 cm and a thickness of 1 to 3 cm. It is preferably made of plastic or a similar light material.

To permit the sharpening rods and the springs to be mounted in the housing, it is preferably divided between the front and back walls. The dividing joint can extend plane-parallel to the front wall and back wall. However, the housing can also be formed in another way, for example in a box shape.

The sharpening rods are preferably mounted on both the front and back walls of the housing. Preferably, the sharpening rods are provided on their front and back sides with pivot pins which engage a recess in the front wall or back wall. Instead, the pivot pins can also be provided on the front and back walls, in which case the recesses engaged by the pivot pins are provided on the front and back sides of the sharpening rods.

To obtain a secure guidance of the sharpening rods, the curved guides are preferably formed by recesses which are provided in both the front and back walls. The mutually parallel curved recesses in the front and back walls are engaged by guiding pins provided on both the front and back sides of the sharpening rods. The springs which load the sharpening rods toward each other and against whose force the sharpening rods are spread apart by a pressure of the knife are preferably formed by steel wires which at one end are preferably fastened to the back wall and at the other end, on the side facing away from the knife insertion opening, attack the side of the sharpening rods facing the curved guide.

For fastening the spring wires, the back wall of the housing preferably has grooves formed thereon into which one end of the spring wire is placed and which are sealed by a projection in the front wall when the front housing member and the back housing member are joined together.

To prevent grinding chips from entering the internal space of the housing except for the area of the sharpening rods, out of which said chips can be removed via the slots in the front wall and back wall, the area of the sharpening rods is separated from the rest of the internal space of the housing preferably by a dividing wall which is provided on the front wall or back wall or partly on the front wall and partly on the back wall. The dividing wall can, in particular if the housing is made of plastic, be formed in one piece with the front member of the housing with the front wall or with the back member of the housing with the back wall.

To connect the front member of the housing with the back member of the housing, sleeve-shaped attachments can be provided on the front or back wall, into which pins are insertable which are fastened to the corresponding opposing wall. In particular in the case of a plastic housing, said sleeve-shaped attachments and locking pins can also be formed in one piece with the front or back wall.

To permit the knife grinding apparatus to be set up on a support, a stand can be linked to the underside, i.e. the side of the housing facing away from the knife insertion, said stand being folded out in the knife sharpening position of the apparatus and folded in the carrying position of the apparatus. The stand is preferably of plate-shaped form and adapted to be slid onto the front wall. For this purpose, the stand can have two pins which engage longitudinal grooves on one and the other of the mutually parallel narrow sides of the housing between which the slots of the insertion openings are located. The pins on the stand thus serve, on the one hand, to guide the stand when it is being shifted into the carrying position, and to swivel the stand slid out of the carrying position into the folded out knife sharpening position.

For fixing the housing in the folded out position at an angle of preferably about 60 to 80° between the housing and the stand, a stop is provided on the housing and/or on the stand. Said stop is preferably formed by side walls on the stand which support the side walls of the back member of the housing in the folded out stand position, i.e. the knife sharpening position.

The side walls of the front member of the housing are shifted inwardly relative to the side walls of the back member of the housing in such a way as to extend on the inner side of the side walls of the stand.

The edges of the flat, cuboid housing are preferably of rounded form to increase the carrying comfort. For this purpose, the stand is preferably also provided on its side facing away from the pin with a cambered end wall which, in the folded in stand position slid onto the housing, engages flush over the end wall of the housing facing away from the knife insertion opening. Likewise, the front wall of the housing is preferably provided on its side facing the knife insertion opening with a projection which, in the folded in position slid onto the housing, engages flush over the plate-shaped stand at the edge where it has the pins. Moreover, the end wall of the housing on which the knife insertion opening is provided is preferably of cambered form. Thus, in the carrying position, the inventive knife sharpening apparatus has smooth outer sides, except for the knife insertion opening, and cambered end walls and thus no edges that could impair the carrying comfort.

BRIEF DESCRIPTION OF THE DRAWINGS

An embodiment of the inventive knife sharpening apparatus will hereinafter be explained more closely with reference to the enclosed drawing. The figures are described as follows.

DETAILED DESCRIPTION

Figure 3:
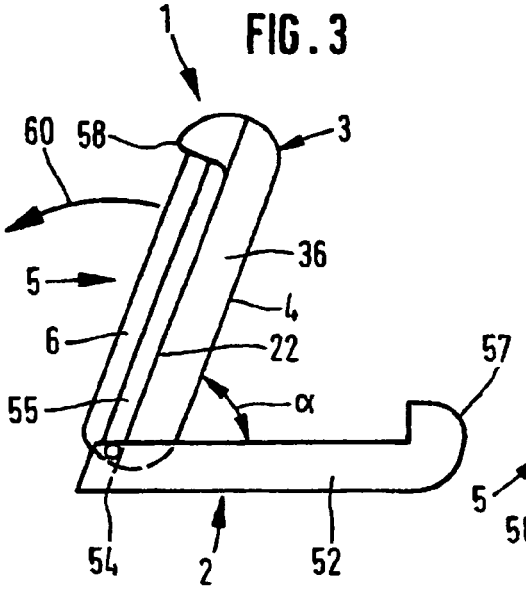
FIG. 3 is a side view of the knife sharpening apparatus in the knife sharpening position.

The knife sharpening apparatus has according to FIG. 3 a housing 1 which is provided with a stand 2.

The housing 1 consists of a back member 3 with the back wall 4 and a front member 5 with the front wall 6. The housing 1 is provided with a knife insertion opening 7 which is formed by parallel extending slots 8, 9 in the back wall 4 and front wall 6, respectively. The slots 8, 9 have an open upper end. They are closed at the lower end.

In the housing 1 sharpening rods 11, 12 are pivot mounted on the side facing the closed end of the slots 8, 9, said rods crossing in the knife insertion opening 7 formed by the slots 8, 9 and being loaded toward each other with springs 13, 14. The other ends of the sharpening rods 11, 12 facing the open ends of the slots 8, 9 are guided in curved recesses 15, 16, 17, 18 in the front wall 6 and back wall 4.

The sharpening rods 11, 12 are each provided on opposing sides, in the grinding area where they cross, with a plate 20, 21 made of ceramic or a similar hard material, for example silicon carbide, tungsten carbide or another hard metal.

The knife blade to be sharpened (not shown) inserted into the knife insertion opening 7 from above is urged for sharpening from above against the crossing sharpening rods 11, 12 which are thereby urged apart against the force of the springs 13, 14, whereupon the blade is drawn through the knife insertion opening 7.

The knife sharpening apparatus is pocket-sized. It thus has approximately the size shown in FIGS. 2 to 5. That is, the housing 1 is formed as an approximately palm-sized, flat cuboid with a length l of for example about 7 cm, a width b of for example about 6 cm and a thickness d of for example about 2 cm. The housing 1 is divided in the middle. That is, the dividing joint 22 extends in a plane that is plane-parallel to the front wall 6 and to the back wall 4, in the center between front wall 6 and back wall 4, so as to form approximately equally high longitudinal side walls 23, 24 and 35, 36 and end walls 27, 28 and 29, 30 on the front wall 6 and back wall 7.

Figure 1:
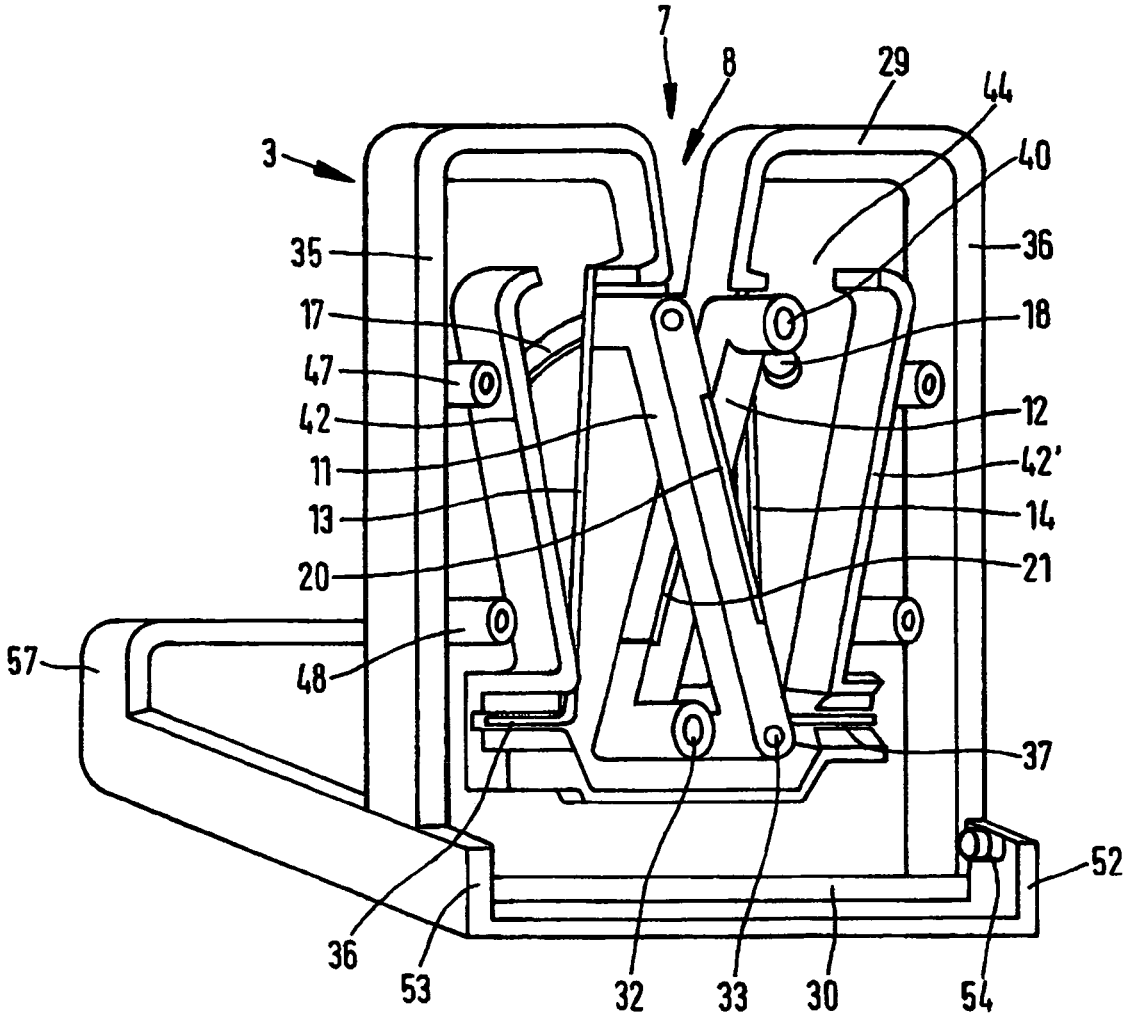
FIG. 1 is a perspective view of the knife sharpening apparatus with the front member of the housing removed.
Figure 2:
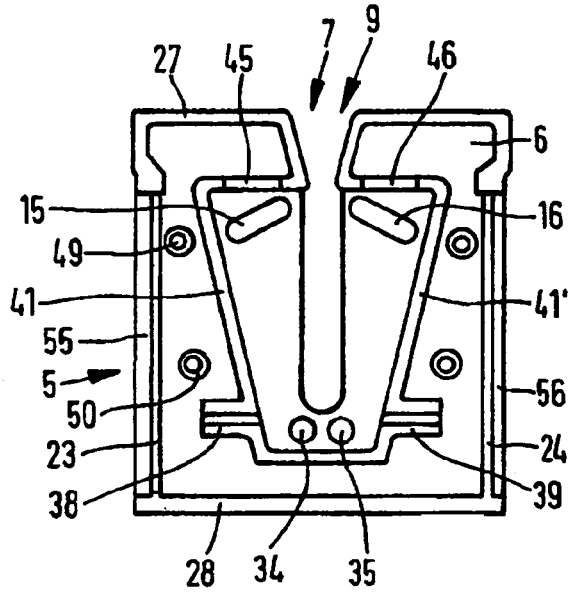
FIG. 2 is a plan view of the inner side of the front member of the housing.

The sharpening rods 11, 12 are mounted both on the front wall 6 and on the back wall 4. For this purpose, a pin is provided on each sharpening rod 11, 12 on the front and back in each case, whereby the drawing, i.e. FIG. 1, shows only the front pins 32, 33. The cylindrical pivot pins 32, 33 each engage a recess in the front wall 6 and back wall 4, whereby the drawing, i.e. FIG. 2, shows only the cylindrical recesses 34, 35 in the front wall 6. At the ends facing away from their rotation axes, the sharpening rods 11, 12 are provided on the front and back with pins 31, 40 which engage the curved guides 15, 16; 17, 18.

The springs 13, 14 loading the sharpening rods 11, 12 are each formed by a wire on one and the other side of the knife insertion opening 7, each spring wire 13, 14 being fastened at one end to the back wall 4 and attacking at the other end the side of the sharpening rods 11, 12 facing away from the knife insertion opening 7. For fastening each spring wire 13, 14, a groove 36, 37 is provided in the back wall 4 according to FIG. 1 to receive the one, angled end of the spring wire 13, 14, the groove 36, 37 being sealed by a projection 38, 39 in the front wall 6.

The area of the sharpening rods 11, 12 is separated from the rest of the internal space of the housing 1 by a dividing wall formed by the wall portions 41, 41' on the front wall 6 and the wall portions 42, 42' on the back wall 4. The wall portions 41, 41', 42, 42' have the same height as the longitudinal side walls 23, 24; 25, 26 and the end walls 27, 28; 29, 30 on the front wall 6 and the back wall 4. The wall portions 42, 42' on the back wall 4 are provided in the area of the springs 13, 14 and the curved recesses 17, 18 with a recess 43, 44 which is engaged by a projection 45, 46 on the wall portion 41 on the front wall 6.

For connecting the front wall 6 with the back wall 4, sleeve-shaped attachments 47, 48 are provided on the back wall 4, into which pins 49, 50 on the front wall 6 are inserted.

The plate-shaped stand 2 is linked to the housing 1 and adapted to be slid onto the front wall 6 of the housing 1. The stand 2 has for this purpose on each longitudinal side wall 52, 53 on the inner side a pin 54 which engages a longitudinal groove 55, 56 in the longitudinal side walls 23, 24 of the front member 5 of the housing 1.

For fixing the housing 1 in the folded out position at an angle a of for example 70°, the longitudinal side walls 35, 36 of the back member of the housing are supported at a corresponding angle on the longitudinal side walls 52, 53 of the stand 2. In contrast, the longitudinal side walls 23, 24 of the front member 5 of the housing 1 extend on the inner side of the longitudinal side walls 52, 53 of the stand 2.

Figure 4:
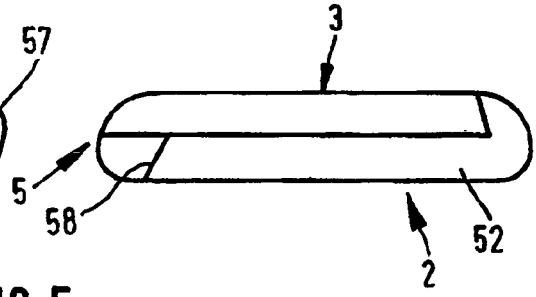
FIGS. 4 and 5 are a side view and a plan view of the knife sharpening apparatus in the carrying position.

The stand 2 is provided on its side facing away from the pins 54 with an end wall 57 that is cambered, i.e. of approximately semicircular cross section, and, in the folded in position of the stand 1 slid onto the housing 1 according to FIG. 4, engages flush over the end wall of the housing 1 facing away from the knife insertion opening 7 and formed by the end walls 28 and 30 of the front member 5 and the back member 3, so as to form a smooth upper side according to FIG. 4. Further, a projection 58 is provided on the front wall 6 of the front housing member 5, which engages flush over the stand 2, in the folded in position slid onto the housing 1, on the edge 61 where the pins 54 are provided, so that the underside is also of smooth form according to FIG. 4. Moreover, the end wall of the housing 1 formed from the end walls 27 and 29 of the two housing members 3, 5 is also of cambered formed in the same way as the end wall 57 of the stand 2.

Figure 5:
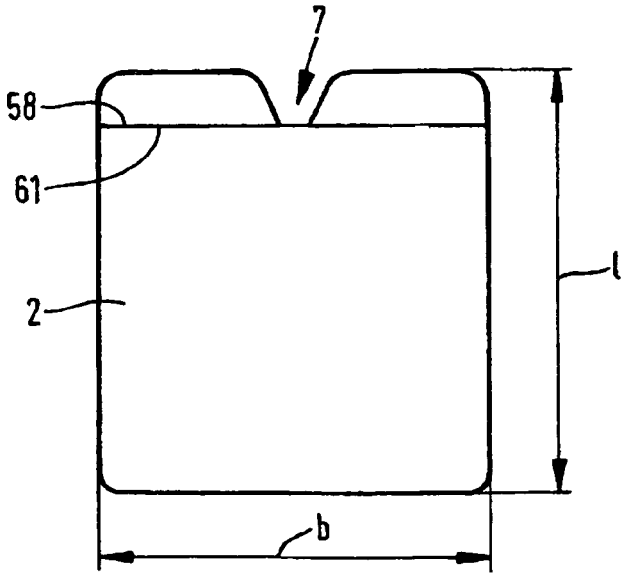

To transfer the knife sharpening apparatus from the sharpening position shown in FIG. 3 to the transport position shown in FIGS. 4 and 5, the housing 1 is folded forward according to the arrow 60 as in FIG. 3 until the housing 1 and the stand 2 are located in a plane, whereupon the housing 1 is slid into the stand 2.

Due to the arrangement of the housing 1 relative to the stand 2 in the sharpening position at an angle $\alpha$, the blade of the knife can be ground but also whetted. For grinding, i.e. for greater removal, the blade is drawn forward, while for whetting, i.e. for honing the cutting edge, the blade is drawn in the opposite direction.

The invention claimed is:

1. A knife sharpening apparatus having two sharpening rods pivot mounted at one end and guided in curved guides at the other end and loaded toward each other by springs, said sharpening rods crossing in a knife insertion opening so that upon pressure on the crossing sharpening rods by the knife inserted into the knife insertion opening, the sharpening rods are spread apart against the force of the springs, wherein the sharpening rods are disposed and mounted in a housing whose front wall and back wall are provided, for forming the knife insertion opening, with mutually parallel slots which are open at one end and closed at the other end, and wherein a stand is linked to the side of the housing facing away from the knife insertion opening, said stand being of plate-shaped form and being adapted to be slid onto said front wall.

2. The knife sharpening apparatus according to claim 1, wherein the housing has a length and a width of 5 to 10 cm and a thickness of 1 to 3 cm.

3. The knife sharpening apparatus according to claim 1, wherein the housing is divided between the front wall and the back wall.

4. The knife sharpening apparatus according to claim 3, wherein a dividing joint extends plane-parallel to the front wall and the back wall.

5. The knife sharpening apparatus according to claim 1, wherein the sharpening rods are mounted both on the front wall and on the back wall.

6. The knife sharpening apparatus according to claim 5, wherein for mounting the sharpening rods, a pivot pin is provided on the sharpening rods in each case on the front and back or on the front wall and the back wall to rotatably engage a recess in the front wall and the back wall or in the sharpening rods.

7. The knife sharpening apparatus according to claim 1, wherein the curved guides for guiding the sharpening rods are formed by recesses in the front wall and the back wall which are engaged by guiding pins provided on the sharpening rods on the front and back.

8. The knife sharpening apparatus according to claim 1, wherein the springs are formed by wires which at one end are fastened to the back wall and at the other end attach the sharpening rods on the side facing away from the knife insertion opening.

9. The knife sharpening apparatus according to claim 8, wherein for fastening each spring, the back wall is provided therein with a groove in which one end of the spring is disposed and which is adapted to be sealed by a projection on the front wall.

10. The knife sharpening apparatus according to claim 1, wherein the area of the sharpening rods is separated from the rest of the internal space of the housing by a dividing wall which is provided on the front wall and/or the back wall.

11. The knife sharpening apparatus according to claim 1, wherein for connecting the front wall with the back wall, the front wall and/or the back wall have provided thereon sleeve-shaped attachments into which pins on the back wall and/or the front wall are adapted to be inserted.

12. The knife sharpening apparatus according to claim 1, wherein the stand, for being linked to the housing, has two pins which engage longitudinal grooves on one and the other narrow side of the housing.

13. The knife sharpening apparatus according to claim 12, wherein the longitudinal grooves are provided in the side wall of the front housing member.

14. The knife sharpening apparatus according to claim 12, wherein the stand is provided on its side facing away from the pin with an end wall which, in the folded in position of the stand slid onto the housing, engages over the end wall of the housing facing away from the knife insertion opening.

15. The knife sharpening apparatus according to claim 1, wherein for fixing the housing in the folded out position at an angle between the housing and the stand of less than 90°, a stop is provided on the housing and/or the stand.

16. The knife sharpening apparatus according to claim 15, wherein the housing comprises front and back housing members and the stand, for forming the stop, has side walls on which side walls of the back housing member are supported in the folded out position of the stand.

17. The knife sharpening apparatus according to claim 16, wherein side walls of the front housing member extend on the inner side of the side walls of the stand.

18. The knife sharpening apparatus according to claim 1, wherein the front wall has on the side facing the slot a projection which engages over the adjacent edge of the stand in the folded in position slid onto the housing.

19. A knife sharpening apparatus having two sharpening rods pivot mounted at one end and guided in curved guides at the other end and loaded toward each other by springs, said sharpening rods crossing in a knife insertion opening so that upon pressure on the crossing sharpening rods by the knife inserted into the knife insertion opening, the sharpening rods are spread apart against the force of the springs, wherein the sharpening rods are disposed and mounted in a housing whose front wall and back wall are provided, for forming the knife insertion opening, with mutually parallel slots which are open at one end and closed at the other end, and wherein a stand is linked to the side of the housing facing away from the knife insertion opening, a stop being provided on the stand for fixing the housing in a folded out position at an angle between the housing and the stand of less than 90°, said stand, for forming said stop, having side walls on which the side walls of the housing are supported in the folded out position of the stand.

20. A knife sharpening apparatus having two sharpening rods pivot mounted at one end and guided in curved guides at the other end and loaded toward each other by springs, said sharpening rods crossing in a knife insertion opening so that upon pressure on the crossing sharpening rods by the knife inserted into the knife insertion opening, the sharpening rods are spread apart against the force of the springs, wherein the sharpening rods are disposed and mounted in a housing whose front wall and back wall are provided, for forming the knife insertion opening, with mutually parallel slots which are open at one end and closed at the other end, and wherein a stand is linked to the side of the housing facing away from the knife insertion opening so as to be foldable between folded in and folded out positions, the front wall on the side facing the slot having a projection which engages over an adjacent edge of the stand when the stand is slid onto the housing in the folded in position.

* * * * *